US008428478B2

(12) United States Patent
Shiozawa

(10) Patent No.: US 8,428,478 B2
(45) Date of Patent: Apr. 23, 2013

(54) IMAGE FORMING APPARATUS

(75) Inventor: Motohide Shiozawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 219 days.

(21) Appl. No.: 12/951,321

(22) Filed: Nov. 22, 2010

(65) Prior Publication Data

US 2011/0129248 A1 Jun. 2, 2011

(30) Foreign Application Priority Data

Dec. 1, 2009 (JP) ..... 2009-273258

(51) Int. Cl.
*G03G 15/00* (2006.01)

(52) U.S. Cl.
USPC ..... 399/45

(58) Field of Classification Search ..... 399/54, 399/82, 85, 223, 323, 341, 45
See application file for complete search history.

(56) References Cited

U.S. PATENT DOCUMENTS

| | | | | |
|---|---|---|---|---|
| 7,715,775 | B2 | 5/2010 | Shiozawa | |
| 2004/0114976 | A1 * | 6/2004 | Weber et al. | 399/341 |
| 2004/0151515 | A1 * | 8/2004 | Nakayama | 399/67 |
| 2005/0063720 | A1 * | 3/2005 | Fujita et al. | 399/45 |
| 2006/0133870 | A1 * | 6/2006 | Ng et al. | 399/341 |
| 2006/0188301 | A1 * | 8/2006 | Ng et al. | 399/341 |
| 2007/0071474 | A1 * | 3/2007 | Watanabe et al. | 399/67 |
| 2008/0160435 | A1 * | 7/2008 | Lim et al. | 430/48 |

FOREIGN PATENT DOCUMENTS

| | | |
|---|---|---|
| JP | 7-271134 A | 10/1995 |
| JP | 10-48868 A | 2/1998 |
| JP | 2003-295687 A | 10/2003 |

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes a selector for selecting a first mode in which a transparent toner image is partly formed on a surface of a recording material and a second mode in which the transparent toner image is formed so that whole surface of the recording material is coated with a transparent toner; and a controller for controlling execution so that execution of the first and second image forming modes are permitted when information indicates that the recording material has not been subjected to image formation before the recording material is placed to a placing portion and so that execution of the second mode is permitted but execution of the first mode is forbidden when the information indicates that the recording material has already been subjected to image formation before the recording material is placed to the placing portion.

4 Claims, 14 Drawing Sheets

(a)

| | |
|---|---|
| 1ST | PLAIN PAPER |
| 2ND | COATED PAPER |
| 3RD | COATED PAPER |
| 4TH | PLAIN PAPER(PRE-PRINT) |
| MANUAL TRAY | PLAIN PAPER |
| FEEDING DECK | COATED PAPER(PRE-PRINT) |

41

(b)

(a)

(b)

IMAGE FORMING APPARATUS

FIELD OF THE INVENTION AND RELATED ART

The present invention relates to an image forming apparatus for forming an image with transparent toner.

In the image forming apparatus using an electrophotographic method, as one of factors for improving image quality, impartation of gloss representation and utilization of a characteristic have been conventionally required.

Specifically, a portion with low gloss and a portion with high gloss are co-present on a surface of an output product (image formed product), or a whole image surface of the output product is uniformly finished to high gloss, medium gloss, low gloss or the like. For example, uses such that an image constituting character information is made legible by lowering the gloss, that a gradation image such as a photograph or an illustration is improved in appearance by increasing the gloss, and that the gradation image is partly increased in gloss to realize emphasized representation would be considered. Further, uses such as subdued representation with low gloss and photographic representation with high gloss as a whole depending on the output product used would be considered.

For the above purposes of adjusting the gloss, transparent toner which is prepared by removing a pigment as a colorant from color toner is used. Specifically, Japanese Laid-Open Patent Application (JP-A) 2003-295687 discloses a method in which only a color toner image is first formed and fixed on a recording material (recording sheet) and then a transparent toner image is formed and fixed on the color toner image.

On the other hand, when the toner is heated by a heating device, due to adhesiveness of the toner, the recording material is less liable to separate from a fixing member. Then, when improper separation occurs, a paper jam is caused.

For that reason, JP-A Hei 07-271134 discloses a technique in which the recording material is more liable to be separated from the fixing member by applying a parting agent onto the fixing member. Further, JP-A Hei 10-048868 discloses a method in which the recording material is more liable to be separated from the fixing member by incorporating the parting agent (wax) into the toner.

The method in which wax is incorporated into the toner is preferable compared with the method in which oil is applied onto a whole surface of the fixing member since the wax is not transferred onto the whole surface of the recording material.

Here, the transparent toner is, as described above, frequently used in the use such that the transparent toner is superposed on the recording material, on which the color toner has already been fixed, and then is fixed on the fixed color toner. Here, in the case where the image is formed by using the wax-containing transparent toner (so-called oil-less toner), it was found, by study of the present inventor, that the following problem arises.

Specifically, in the case where the toner image is formed with the wax-containing transparent toner on a print (so-called pre-print paper) outputted by another apparatus, i.e., on the recording material on which the toner image has been fixed once (in the case of multiple fixing), the following problem arises.

That is, in the case where the image is formed on the pre-print paper with the toner containing no wax, when the image is intended to be formed only at a part of the pre-print paper with the wax-containing toner, the toner containing no wax is melted and the pre-print paper is caught in a fixing device, thus causing the jam.

SUMMARY OF THE INVENTION

A principal object of the present invention is to provide an image forming apparatus capable of reducing a degree of an occurrence of improper separation jam in the case where pre-print paper is subjected to additional fixing (in the case of multiple fixing).

According to an aspect of the present invention, there is provided an image forming apparatus comprising:

image forming means for forming a toner image on a recording material with transparent toner containing a parting agent;

fixing means for fixing on the recording material the toner image formed by the image forming means;

obtaining means for obtaining information as to whether or not the recording material on which the toner image is to be formed has already been subjected to image formation;

selecting means for selecting a mode to be executed from a first image forming mode in which the toner image depending on image data is formed on the recording material by the image forming means and a second image forming mode in which the toner image is formed so that a whole surface of the recording material is coated in an image formable area with the transparent toner by the image forming means; and control means for controlling execution of the mode so that execution of the first image forming mode and execution of the second image forming mode are permitted when the information indicates that the recording material has not been subjected to the image formation and so that execution of the second image forming mode is permitted but execution of the first image forming mode is forbidden when the information indicates that the recording material has already been subjected to the image formation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the present invention will be described more specifically based on embodiments.

Incidentally, these embodiments are examples of preferred embodiments in the present invention but the present invention is not limited to constitutions of these embodiments.

[Embodiment 1]

(1) General Structure of Image Forming Apparatus

Figure 1:
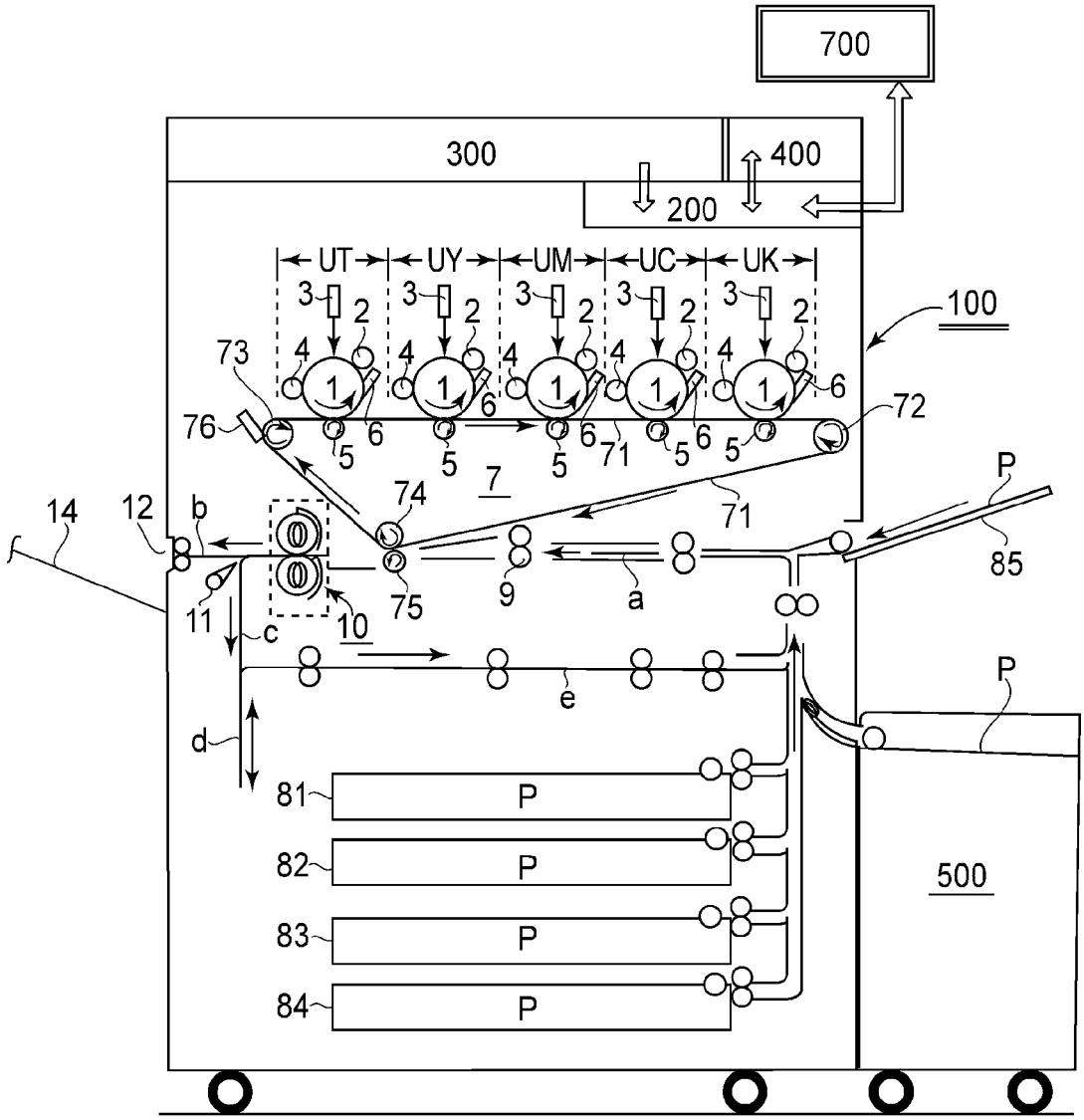
FIG. 1 is a schematic view of an image forming apparatus in Embodiment 1.

FIG. 1 is a schematic view of an image forming apparatus to which the present invention is applied. This image forming apparatus 100 is full-color electrophotographic image forming apparatus at a tandem (in-line) type, an intermediary transfer type, and an oil-less fixing type, and is a multi-function machine having a copying machine function, a printer function and a facsimile function. The apparatus 100 includes a control device (controller) 200, an image reading device (image scanner) 300 and an operating portion 400. Further, to the apparatus 100, a large-volume sheet feeding deck 500 as an optional device to be retrofitted is attached in combination.

The control device 200 is constituted by a central processing unit (CPU) or the like and is a control circuit portion as a control means for integrally controlling an image forming system including various process equipment and devices which relative to image formation by the apparatus 100. The control device 200 performs transfer of electric signals between itself and the image reading device, the operating portion 400 or an external host device 700 such as a personal computer (PC), thus effecting image forming sequence control of the image forming system. Further, the control device 200 includes a storing device such as an HDD and thus can temporarily store data filed transferred from the external host device 700 a data read from the image reading device 300. A user can select the stored data and can output the data as a print as desired. Further, the user can select either of data transmitted from the external host device 700, image data read by the image reading device 300 and data stored in the storing device such as the HDD and then can output the data as an image formed product.

In the case of a copying machine mode, electrical image information, of an original which has been subjected to color-separated photoelectric reading by the image reading device 300 is inputted into an image processing portion of the control device 200. The electrical image information inputted into the image processing portion is image-processed into an image signal of each color component, so that the apparatus 100 performs the image forming operation as the copying machine. In the case of a printer mode, the electrical image information is inputted from the PC or the like as the external host device 700 into the image processing portion of the control device 200, so that the apparatus 100 performs the image forming operation as the printer. In the case of a facsimile recording mode, the electrical image information is inputted from a remote facsimile device as the external host device 700 into the image processing portion of the control device 200, so that the apparatus 100 performs the image forming operation as a facsimile receiving device. In the case of a facsimile transmitting mode, the electrical image information, of the original, which has been subjected to the photoelectric reading by the image reading device 300 is inputted into the control device 200. Then, the electrical image signal is transmitted from the control device 200 to the remote facsimile device, so that the apparatus 100 functions as a facsimile transmitting device.

The apparatus 100 includes a plurality of image forming stations which are horizontally tandem-arranged successively from the left side to the right side on the drawing (hereinafter, referred to as image forming portions). The apparatus 100 in this embodiment includes first to fifth image forming portions U (UT, UY, UC, UK) as fine image forming means for forming toner images different in color. The first image forming portion UT forms the toner image of particular color (T). As the particular color, e.g., red, green, blue, perl, transparent (clear), and the like can be applied. The second image forming portion UY forms a yellow (Y) toner image, the third image forming portion UM forms a magenta (M) toner image, the fourth image forming portion UC forms a cyan (C) toner image, and the fifth image forming portion UK forms a black (K) toner image.

Each of the image forming portions U is an electrophotographic process mechanism having the substantially same structure except that the color of the toner as a developer is different. Each of the image forming portions U includes a drum-type electrophotographic photosensitive member as a rotatable image bearing member for forming an electrostatic latent image (hereinafter, referred to as a drum). Further, each of the image forming portions U includes, as process means acting on the drum 1, a charging means (charging roller) 2, an exposure means (exposure unit such as laser scanner or LED array) 3, a developing means 4, a primary transfer means (primary transfer roller) 5, a cleaning means 6 and the like.

Here, the toner used as the developer in each developing means 4 will be described. Since a fixing means 10 described later is an oil-less fixing type fixing device, the toner as the developer contains a parting agent. Incidentally, the toner image formed on pre-print paper has already been fixed, so that the above-described fixing device heats the toner as a heating means when the point of view is changed. As the toner, either of magnetic toner and non-magnetic toner is selectable, so that either of a one component developer using only the toner and a two component developer using the toner and a carrier is also selectable. In this embodiment, as the toner, the toner using polyester-based resin was used. The toner can also be manufactured by a pulverization method but in this embodiment, a method (polymerization method), in which the toner is directly manufactured in a medium, such as suspension polymerization, interfacial polymerization or dispersion polymerization may preferably be used. Incidentally, the components and the manufacturing method are not limited to those described above.

To the color toner, 5 wt. % of a low-melting point wax is added as the parting agent. The wax used as the parting agent may include wax-like substances such as polypropylene, polyethylene, microcrystalline wax, carnauba wax, sasol wax, paraffin wax and may include oxides, graft-modified products and the like of these substances. As the particular color toner, e.g., red toner, green toner, blue toner, perl toner, transparent (clear) toner and the like are applicable. With respect to the transparent toner, the transparent toner manufactured by the substantially same manufacturing method as that of the color toners except that a step of adding a pigment component is omitted from a color toner manufacturing process is used. A main binder resin use was also the same, and an addition amount of the wax and a formulation of an external additive were also the same. A glass transition temperature (Tg) of the binder resin used in the toner may preferably be 40° C. to 70° C., further preferably 45° C. to 65° C. The binder resin may be used singly or generally used by appropriately mixing monomers so that the resultant mixture has a theoretical glass transition temperature (Tg), described in Polymer Handbook, Second Edition, Section III, pp. 139-192 (published by John Wiley & Sons, Inc.), of 40° C. to 70° C.

Under the first to fifth image forming portions UT, UY, UM, UC and UK, an intermediary transfer unit 7 is disposed. The unit 7 includes a flexible endless intermediary transfer belt 71 as an intermediary transfer member movable in contact with a lower surface of the drum 1 of each of the image forming portions U. The belt 71 is extended around a driving roller 72, a tension roller 73 and an inner secondary transfer roller 74 and is circulated and moved in a clockwise direction indicated by an arrow at a predetermined speed by rotating the driving roller 72 in the clockwise direction indicated by an arrow at a predetermined speed. Each primary transfer means 5 primary-transfers the toner image formed on the drum 1 onto the surface of the belt 71 at a primary transfer portion which is a contact portion between the drum 1 and the belt 71. Each primary transfer means 5 is a rotatable primary transfer roller (electroconductive elastic roller) contacted to the belt 71 contacting the drum 1. To the inner secondary transfer roller 74, the belt 71 contacting an outer secondary transfer roller (secondary transfer means) 75 is contacted. A contact portion between the belt 71 and the outer secondary transfer roller 75 is a secondary transfer portion.

A full-color image forming operation is as follows. The drum 1 of each of the image forming portions UT, UY, UM, UC and UK is driven. The apparatus 100 in this embodiment operates (rotates) at a process speed of 130 mm/sec. The belt 71 is also rotated at a speed corresponding to the rotational speed of the drum 1. Each exposure unit 3 is also driven. With respect to the exposure unit 3, an exposure scanning speed is set correspondingly to the rotation of the drum 1 at the process speed described above.

In synchronism with the drive, the surface of the drum 1 is primary-charged uniformly by the charging roller 2 to a predetermined polarity and a predetermined potential with predetermined control timing in each of the image forming portions U. Then, to the exposure unit 3 of the first image forming portion UT, a toner color component image signal of the full-color image is outputted from the control device 200 with predetermined control timing. To the exposure unit 3 of the second image forming portion UY, a Y color component image signal of the full-color image is outputted from the control device 200 with predetermined control timing. To the exposure unit 3 of the third image forming portion UM, an M color component image of the full-color image is outputted from the control device 200 with predetermined control timing. To the exposure unit 3 of the fourth image forming portion UC, a C color component image signal of the full-color image is outputted from the control device 200 with predetermined control timing. To the exposure unit 3 of the fifth image forming portion UK, a K color component image of the full-color image is outputted from the control device 200 with predetermined control timing. Each exposure unit 3 subjects the surface of each drum 1 to scanning exposure to a light beam modulated correspondingly to the image signal for each color component. As a result, on the surface of the drum 1 of each image forming portion U, the electrostatic latent image depending on an associated color image signal is formed. The formed electrostatic latent image is developed as the toner image by the developing means 4.

By the electrophotographic image forming process operation described above, the T toner image is formed on the drum 1 of the first image forming portion UT and then is primary-transferred onto the belt 71 at the primary transfer portion of the first image forming portion UT. The Y toner image is formed on the drum 1 of the second image forming portion UY and then is superposedly primary-transferred onto the T toner image, which has already been transferred onto the belt 71, at the primary transfer portion of the second image forming portion UY. The M toner image is formed on the drum 1 of the third image forming portion UM and then is superposedly primary-transferred onto the T and Y toner images, which have already been transferred onto the belt 71, at the primary transfer portion of the third image forming portion UM. The C toner image is formed on the drum 1 of the fourth image forming portion UC and then is superposedly primary-transferred onto the T, Y and M toner images, which have already been transferred onto the belt 71, at the primary transfer portion of the fourth image forming portion UC. The K toner image is formed on the drum 1 of the fifth image forming portion UK and then is superposedly primary-transferred onto the T, Y, M and C toner images, which have already been transferred onto the belt 71, at the primary transfer portion of the fifth image forming portion UM.

The primary transfer of the toner image from the drum 1 onto the belt 71 in each image forming portion U is electrostatically performed by applying a pressing roller primary transfer bias from a power source portion (not shown) to the primary transfer roller 5 with predetermined control timing. Further, in each image forming portion U, primary transfer residual toner remaining on the surface of the drum 1 without being transferred onto the belt 71 during the primary transfer is removed by the cleaning means 6. Thus, the photosensitive drum 1 subjected to cleaning at its surface is subjected to subsequent image formation.

As described above, unfixed T, Y, M, C and K toner images for a four-color based full-color image are synthetically formed on the belt 71. These unfixed toner images formed on the belt 71 are conveyed to the secondary transfer portion which is the contact portion between the belt 71 and the outer secondary transfer roller 75.

On the other hand, with predetermined control timing, one of sheets of the recording material (recording sheets) is fed from a sheet feeding means.

Figure 2:
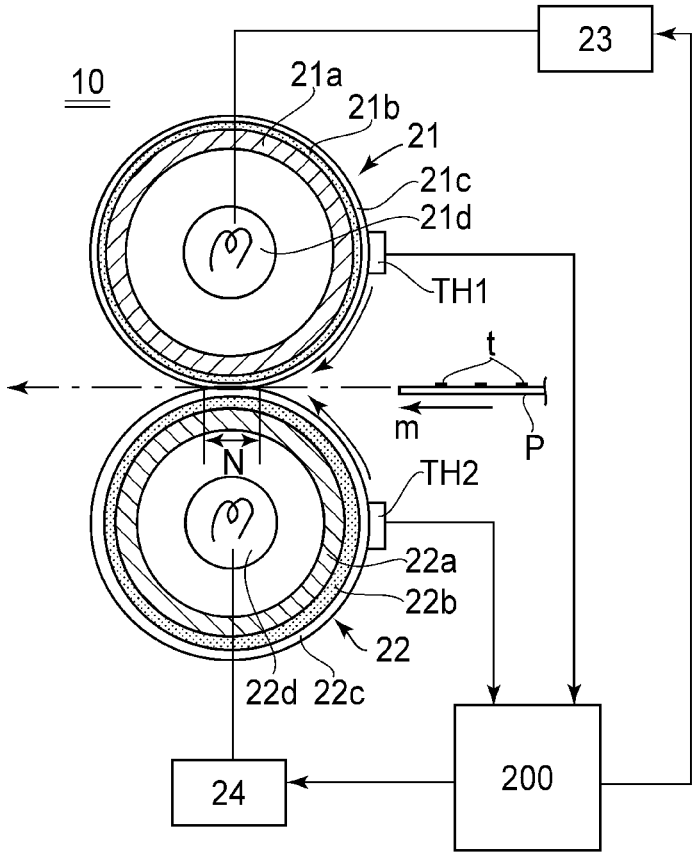
FIG. 2(*a*) is a schematic view showing an operation screen on which the type of a recording material is designated, and FIG. 2(*b*) is a schematic cross-sectional view of a principal part of a fixing device.

In the apparatus 100 in this embodiment, as the sheet feeding means, first to fourth sheet feeding cassettes 81, 82, 83 and 84 are vertically disposed. Further, as the sheet feeding means, a manual feeding tray 85 and a large-volume sheet feeding deck 500 are disposed. The types of sheets of the recording material stacked in the respective sheet feeding means are registered by a registration means on the operating portion 400, so that registered information is stored in a storing portion of the control device 200. Then, as shown in FIG. 2(*a*), the recording material to be used can be selected by a selecting means 41 (recording material type designating means: RM type selecting screen of touch panel type) on the operating portion 400 while confirming the types of sheets of the recording material accommodated in the respective sheet feeding means.

One sheet of the recording material P, in the sheet feeding means, selected and designated by the selecting means 41 is separated and fed. The fed recording material P is passed through a sheet conveying path a and is sent to registration rollers 9. The registration roller 9 effects correction of oblique movement of the recording material P and control of timing of the secondary transfer of the toner image from the belt 71 to the recording material P, and receive a leading end of the recording material P passing through the conveying path a and once stop the recording material P. Then, the recording material P is introduced into the secondary transfer portion by the rotationally driven rollers 9 with predetermined control timing and is nip-conveyed in the secondary transfer portion. During passing of the recording material P through the secondary transfer portion, to the outer secondary transfer roller 75, a pressing roller secondary transfer bias is applied from the power source (not shown). As a result, the unfixed toner images for the full-color image are collectively secondary-transferred electrostatically from the belt 71 onto the surface of the recording material P.

The recording material P coming out of the secondary transfer portion is separated from the surface of the belt 71 and is then introduced into the fixing means (heating means) 19. The surface of the belt 71 after the separation of the recording material P is cleaned by a belt cleaning means 76 and is then subjected to subsequent image formation repetitively. As the fixing means (heating means) 10, a heating roller fixing device of an oil-less fixing type is used. The recording material P is nip-conveyed in a fixing nip. As a result, the unfixed toner images for the full-color image on the recording material P are fixed under heat and pressure. The fixing device 10 will be described in (2) appearing hereinafter.

The recording material P coming out of the fixing device 10 is, in the case of one-side image forming modem changed in path toward a conveying path b by a first turning attitude of a flapper 11 and then is discharged from a discharge opening 12 onto a discharging tray 14. Further, in the case of a both-side image forming mode, the recording material P which has been subjected to first-side image formation and has come out of the fixing device 10 is changed in path toward a conveying path c by a second turning attitude of the flapper 11. Then, the recording material P is introduced into a switch-back conveying path d. Then, the recording material P is reverse-conveyed through the conveying path d and then is passed through a re-conveying path e, thus being introduced into the conveying path a again. As a result, the recording material P which has been subjected to the first-side image formation is re-introduced into the secondary transfer portion in an upside-down state, so that the unfixed toner images are secondary-transferred onto a second surface (side) of the recording material P. The recording material P is then introduced again into the fixing device 10. As a result, the recording material P which has been subjected to the image formation on both sides thereof is outputted from the fixing device 10. This recording material P is changed in path toward the conveying path b by the first turning attitude of the flapper 11 and is then discharged onto the discharging tray 14 as an image formed product (output product).

In the case of a monochromatic (single color) image forming mode, the image forming operation in the image forming portion for designated color is performed and with respect to other image forming portions, only drive of the drum 1 is mode (idling) and thus the image forming operation is not performed.

Here, the flapper 11 includes a rotation shaft and a blade rotatable about the rotation shaft. The flapper 11 has the function of switching the conveying path of the recording material P. The rotation shaft of the flapper 11 is connected to a driving motor (not shown), and the CP 100 controls a rotational direction or the like of the motor, so that the direction (position) of the blade of the flapper is controlled.

(2) Fixing Device 10

FIG. 2(*b*) is a schematic view of a principal part of the fixing device 10 in the apparatus 100 shown in FIG. 1. This fixing device 10 is the fixing means which includes, a fixing member 21, provided with a parting layer 21*c*, for heat-fixing toner images t in contact with the surface of the recording material P on which the toner images t are formed. Onto the fixing member 21, a parting agent is not applied. More specifically, the fixing device 10 in this embodiment is the heating roller fixing device of the oil-less fixing type in which the recording material P is made liable to be separated from the fixing member by using the parting agent containing toner as the developer and the parting agent is not applied onto the fixing member.

The fixing device 10 fixes the toner images t on the recording material P by nip-conveying the recording material P conveyed from the secondary transfer portion in the fixing nip N to simultaneously heat and press the toner images t and the recording material P, thus effecting processing of a fixing step. The fixing device 10 includes a roller pair consisting of a rotatable fixing roller 21 as a first fixing member and a rotatable pressing roller 22 as a second fixing member which is contacted to the fixing roller 21 to form the fixing nip N with a predetermined width with respect to a recording material conveying direction m. The fixing roller 21 and the pressing roller 22 are disposed in substantially parallel to each other, and a manual pressure is 50 kg in total.

The fixing roller 21 is constituted as a lamination roller prepared by laminating a rubber layer as an elastic layer 21*b* and a fluorine-containing resin layer as a toner parting layer 21*c* on a hollow core metal 21*a* of metal such as aluminum (Al) or iron (Fe). As the parting layer 21*c*, it is possible to utilize fluorine-containing resin such as FRP, PFA or PTFE, or fluorine-containing rubber, silicone rubber, silicon resin, or the like. Inside the hollow core metal 21*a*, a halogen heater as a heating source 21*d* is disposed. As the heating source, other than the halogen heater, e.g., it is also possible to use an induction heating (IH) type device utilizing electromagnetic induction heating. Further, the fixing roller 21 is connected to a driving motor (not shown) controlled by the control device 200 through a gear train (not shown) and is rotationally driven in the clockwise direction on the drawing at a predetermined speed by rotational power of the motor.

The pressing roller 22 is a lamination roller prepared, similarly as in the fixing roller 21, by laminating the rubber layer as an elastic layer 22*b* and the fluorine-containing resin layer as a toner parting layer 22*c* on a hollow core metal 22*a*. Inside the hollow core metal 22*a*, a halogen heater as a heating source 22*d* is disposed. As the heating source, it is also possible to use the above-described IH type device utilizing electromagnetic induction heating. The pressing roller 22 rotated together with the fixing roller 21 by the rotation of the fixing roller 21.

On the surfaces of the fixing roller 21 and the pressing roller 22, as detecting means for detecting respective temperatures, thermistors TH1 and TH2 are disposed in contact with or in non-contact with the fixing roller 21 and pressing roller 22, respectively. The fixing roller 21 and the pressing roller 22 are rotated and to the heating sources 21*d* and 22*d*, power is supplied from energization circuit portions 23 and 24, respectively. As a result, the fixing roller 21 and the pressing roller 22 are heated by an internal heating method.

Then, the surface temperatures of the fixing roller 21 and the pressing roller 22 are detected by the thermistors TH1 and TH2, respectively. Electric information (temperature detection signals) on the surface temperatures of the both rollers 21 and 22 detected by the thermistors TH1 and TH2 is inputted into a temperature control function portion of the control device 200. The temperature control function portion effects ON/OFF control of energization from the energization circuit portions 23 and 24 to the heating sources 21*d* and 22*d* so that the temperature detecting signals inputted from the thermistors TH1 and TH2 are kept at those corresponding to fixing temperatures set for the fixing roller 21 and the pressing roller 22, respectively. In this embodiment, the fixing temperature of the fixing roller 21 is set at 180° C. and the fixing temperature of the pressing roller 22 is set at 150° C., and the fixing roller 21 and the pressing roller 22 are temperature-controlled by the control by the temperature control function portion of the control device 200 so as to keep the fixing temperatures.

The recording material P which has been conveyed from the secondary transfer portion and which carries thereon the unfixed toner images t is introduced into the fixing nip N and is heated and pressed during nip-conveyance in the fixing nip N. As a result, the unfixed toner images t are fixed on the surface of the recording material P as a fixed image. The recording material P comes out of the fixing device 10 and then is discharged as the image formed product. The temperature of the recording material P sent from the fixing nip N, i.e., a "sheet separation temperature" at which the recording material P starts separation thereof from the roller surfaces is kept at a high temperature of, e.g., about 90° C. to about 110° C. That is, the fixing device 10 in this embodiment is of a "high temperature separation type" in which the recording material P starts its separation from the roller surfaces while being kept at the high temperature immediately after the recording material P completely pass through the fixing nip N.

Incidentally, in this embodiment, the fixing device 10 constituted by the roller pair consisting of the fixing roller 11 and the pressing roller 12 is described. However, the fixing device 10 can also be constituted by one fixing member with the roller member on either one of the fixing side and the pressing side and by the other fixing member with an endless belt. Thus, as at least one of the fixing members, the belt can be used.

(3) Image Forming Mode

In the image forming apparatus 100 in this embodiment, the first image forming portion UT forms the transparent toner image. Each of the transparent toner used in the first image forming portion UT and the color toners ofY, M, C and K used in the second to fifth image forming portions UY, UM, UC and UK employed the binder resin having the glass transition temperature Tg of 55° C.

Figure 3A:
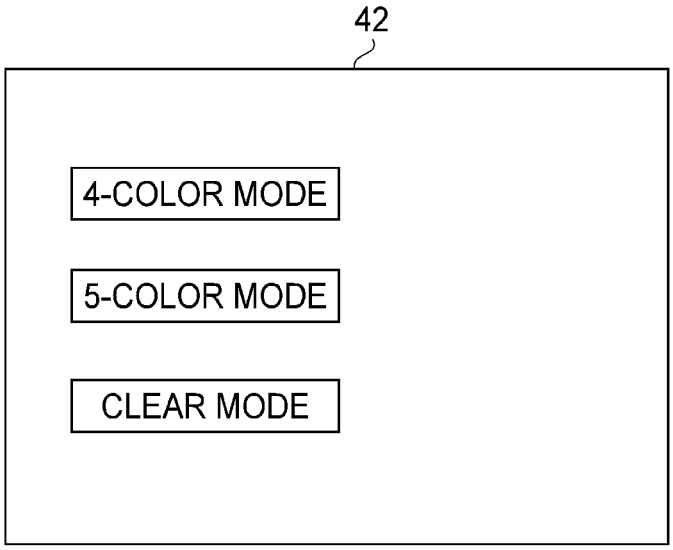
FIG. 3A is a schematic view of a mode selection screen at a display portion of an operating portion.
Figure 3B:
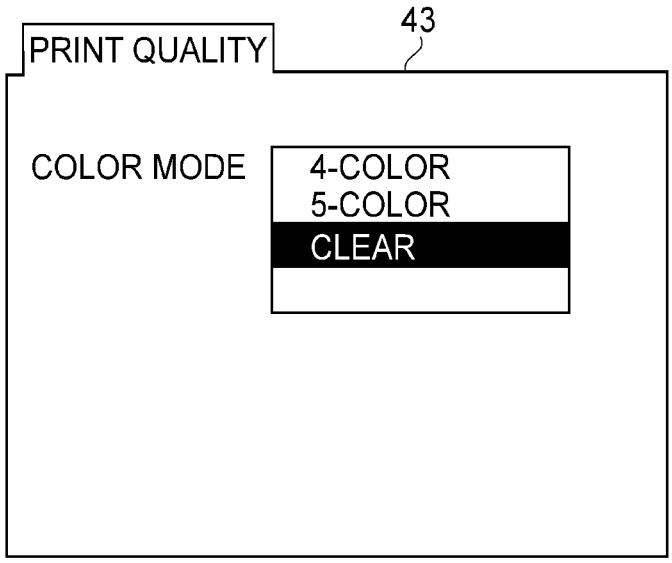
FIG. 3B is a schematic view of the mode selection screen for a printer driver on a personal computer (PC) as an external host device.

An operating mode of the apparatus 100 includes a four-color image forming mode using the color toners, a five-color image forming mode using the transparent toner as the toner of the particular color in addition to the color toners, and a transparent mode in which an image of only the transparent toner is formed. These modes are selectable on a mode selection screen. FIG. 3A is a mode selection screen 42 at a display portion of an operating portion 400 of the apparatus 100. FIG. 3B shows an example of a mode selection screen 43 of a printer driven on the PC at the external host device 700.

Figure 3C:
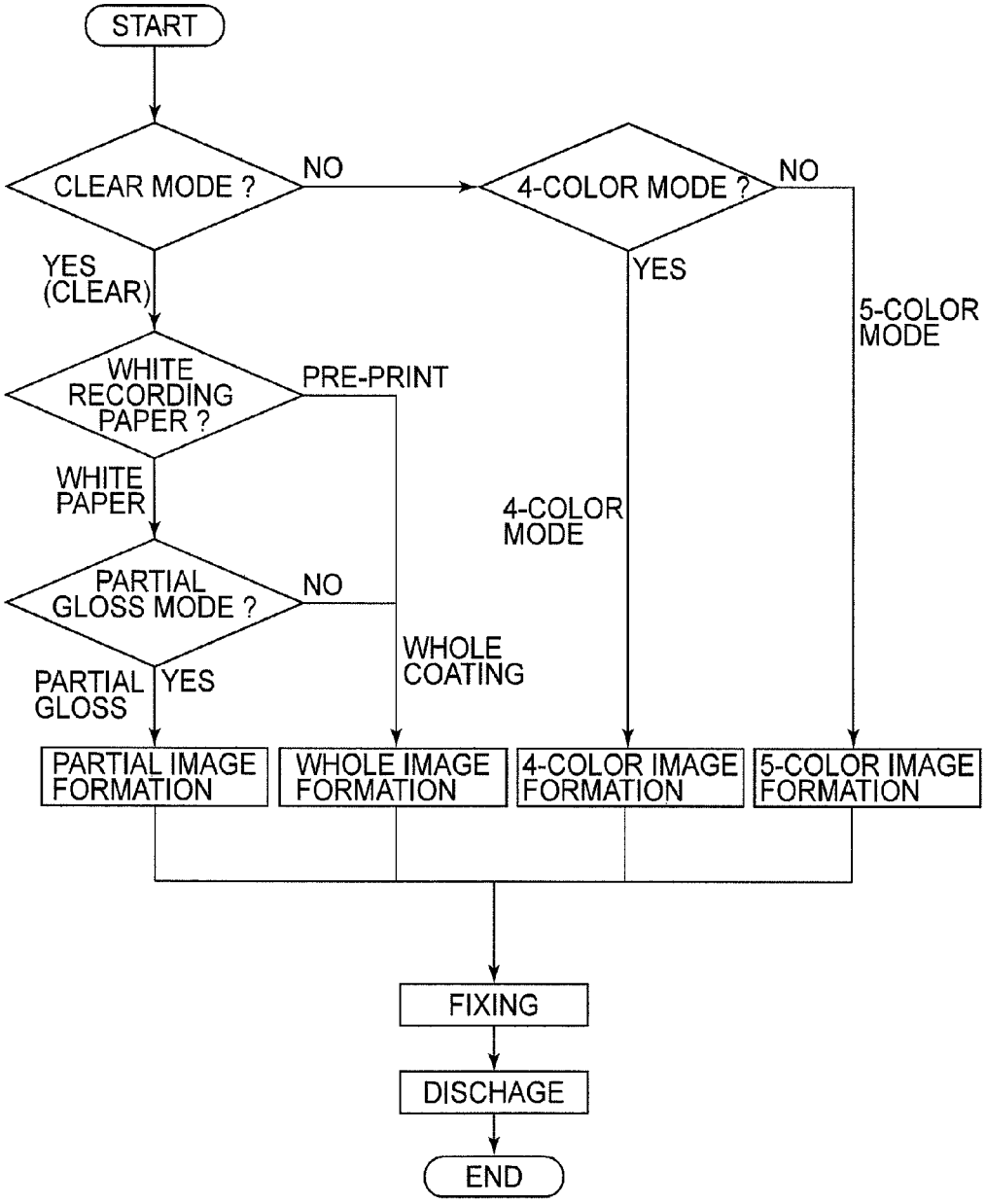
FIG. 3C is a flowchart of an image forming operation.

The control device 200 effects control of the image forming operation of the apparatus 100 on the basis of the mode selection described above in accordance with an operation flowchart of FIG. 3C. When the four-color image forming mode or the five-color image forming mode is selected, the recording material is fed from the sheet feeding means. By the operation of the first to fifth image forming portions, image formation of four colors or five colors is effected.

The transparent mode can be further divided into two image forming modes. One is a mode used for representing partial gloss difference by partly forming an image pattern of the transparent toner (first image forming mode in which the toner image depending on the image data is formed on the recording material). The other is a mode used for representing uniform gloss by coating the transparent toner on the whole surface of the recording material (second image forming mode in which the toner image is formed so as to uniformly cover the whole surface of the recording material with the transparent toner).

Figure 4:
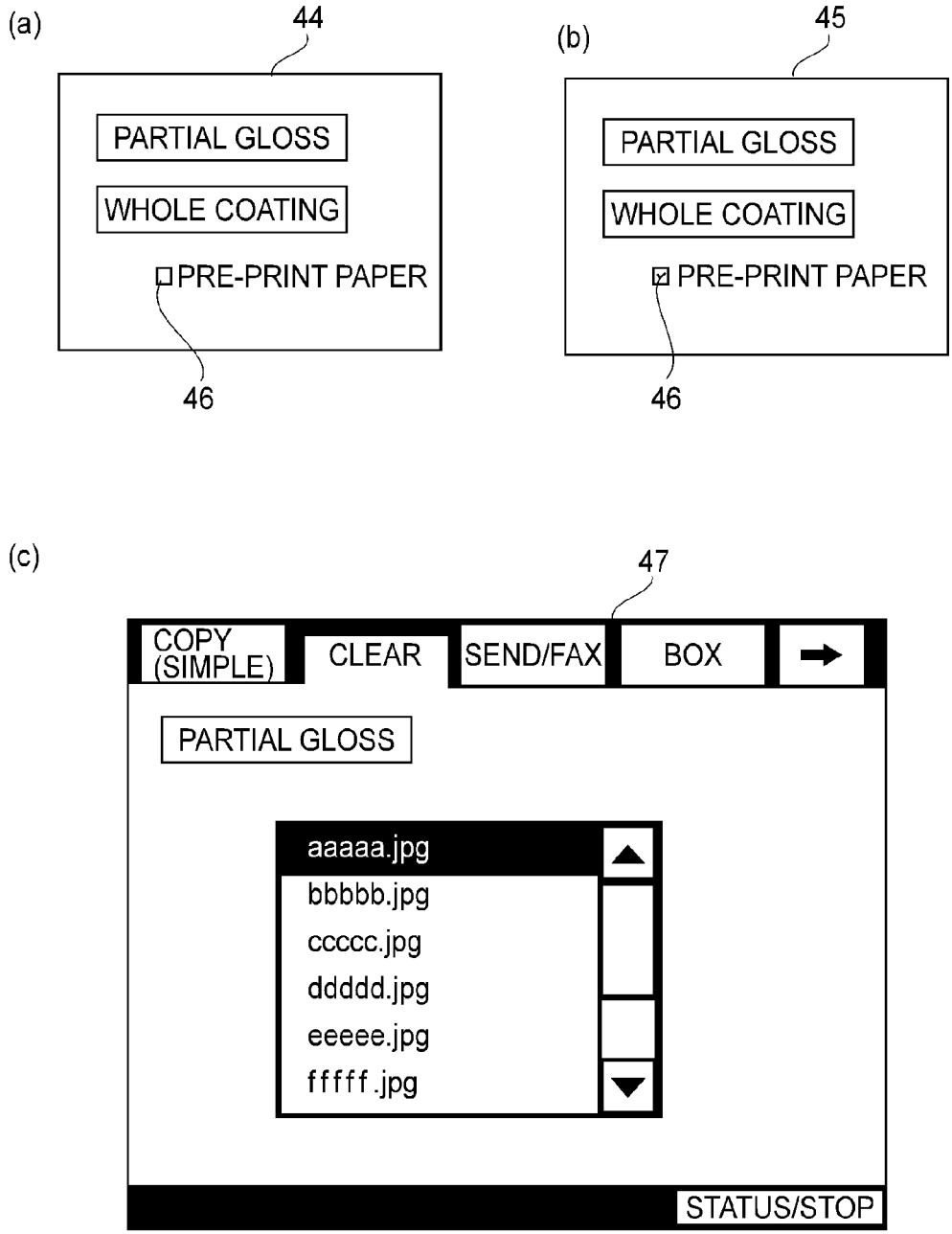
FIGS. 4(*a*) and 4(*b*) are schematic views each showing screen display for selecting "PARTIAL GLOSS" or "WHOLE COATING" at the display portion of the operating portion or on a printer driver screen, and FIG. 4(*c*) is a schematic view of a list display screen for document files and image files.

When the transparent mode is selected, as shown in FIG. 4(*a*), a screen 44 or 45 for selecting "partial gloss" (first image forming mode) or "whole (surface) coating" (second image forming mode) is displayed at the display portion of the operating portion 400 or on the printer driver screen. On this screen, at the same time, it is possible to designate, by a recording material type designating means, that the recording material to be passed through the apparatus is pre-print paper.

When the "partial gloss" mode is selected, the operation mode goes to the mode in which the image data is printed, so that a list of document files and image files stored in the HDD of the control device 200 is displayed on a display screen 47 as shown in FIG. 4(*c*) at the display portion of the operating portion 400 or on the printer driver screen. Alternatively, the image data may also be the image read by the image reading device 300 or the image data sent from the PC 700. Here, by selecting the data intended to be outputted on the display screen 47, the control device 200 generates video data depending on the designated data. The control device 200 in this embodiment treats the video data in 8 bits and generates the video data converted into values from 0 to 255 depending on the image data. In this "partial gloss" mode, the second to fifth image forming portions UY, UM, UC and UK for forming the color toner images are not operated (idling of the photosensitive drum 1). The video data is sent to only the first image forming portion UT for forming the transparent toner image, so that the image forming operation is performed and the transparent toner image depending on the generated video data is formed and outputted.

Figure 5:
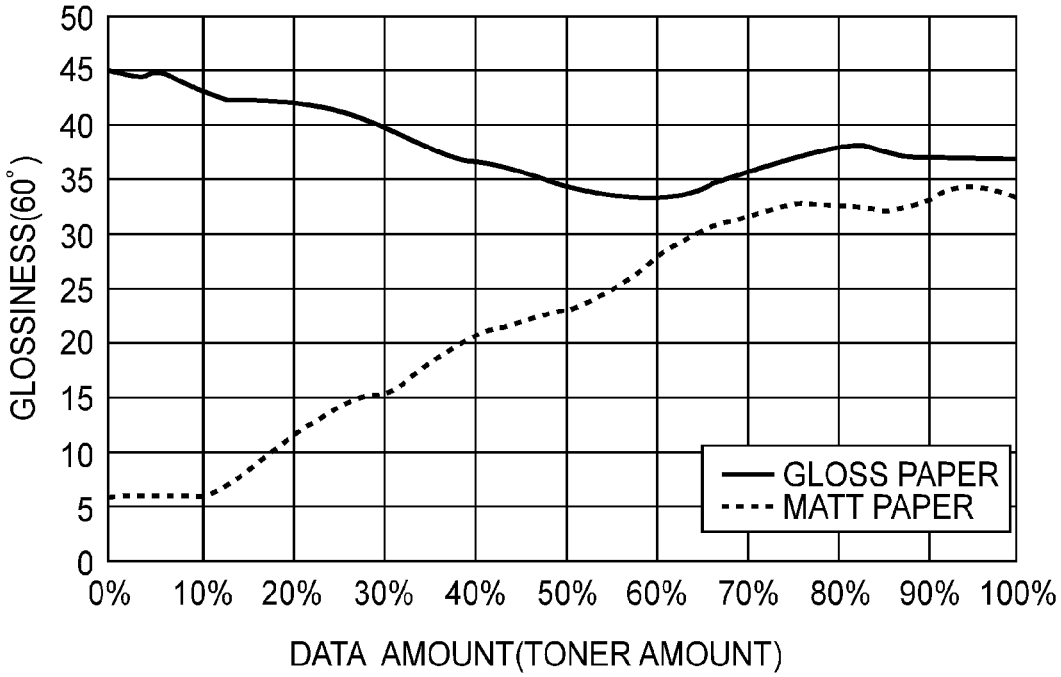
FIG. 5 is a graph showing a relationship between a toner amount and glossiness.

In the case of the color toner, an image density is increased in proportion to the toner amount per unit area, but the density is not generated in the case of the transparent toner and the image density is perceived as a change in gloss. Further, it is found that when the surface of the recording material P is coated with the clear toner (transparent toner), the gloss is not changed even with the amount of the clear toner increased further. In an experiment in this embodiment, glossiness of sheets outputted by using gloss coated paper and matt coated paper and by changing the toner amount was measured in terms of 60-degree glossiness by a specular glossiness measuring method (JIS Z 8741). As a result, with respect to the toner amount when the video data from 0 to 255 are provided, in a range of 60% or more, a substantially constant glossiness (FIG. 5). In a gloss measuring method, a handy glossimeter ("PG-1M", mfd. by Nippon Denshoku Industries Co., Ltd.) was used (in accordance with the specular glossiness measuring method (JIS Z 8741)).

In this embodiment, when the "whole coating" mode is selected and the printing is effected, the control device 200 as the control means generates the video data without using the data file for output. In this case, the video data of 153 which is 60% of 255 is provided to the first image forming portion UT for forming the transparent toner image with respect to a range corresponding to a printable area (substantially whole area of sheet) which corresponds to the designated size of the recording material. As a result, it is possible to output a resultant product coated with the transparent toner in the whole area of the recording material.

In this embodiment, in the case where the pre-print paper is not designated as the recording material to be used for being passed through the apparatus 100, as shown in FIG. 4(*a*), either of the "partial gloss" mode and the "whole coating" gloss was selectable. In the case where the pre-print paper was designated, the "partial gloss" mode was usable to be selected and disablement of the selection was shown by, e.g., being grayed out.

That is, in the case where the pre-print paper is designated, only the "whole coating" mode (second image forming mode) using the max-containing toner is permitted but the "partial gloss" mode (First image forming mode) is forbidden. As a result, in the case of jam trouble due to an erroneous operation, i.e., in the case where the clear output machine is of the oil-less fixing type, fixing winding jam which can occur when the clear toner image is output (formed) on the pre-print paper free from the wax is prevented.

In the case where the transparent toner image containing the wax is formed on a part of the pre-print paper, the pre-printed image can be formed with the color toner containing the wax. However, it is difficult to judge as to whether the image formed on the pre-print paper is formed with the color toner containing the wax or is formed with the color toner containing no wax. Further, the case where the image is formed on the pre-print paper (recording material) by an ink jet method would be considered.

However, in either case, it is difficult for a general user to judge that the image formed on the pre-print paper is formed by what method. For that reason, in this embodiment, even when what image on the pre-print paper is formed by what method, in order to suppress the occurrence of the jam on a top-priority basis, the execution of the partial gloss mode is forbidden.

Here, with respect to the toner amount per unit area of the toner image to be formed on the recording material P in the second image forming mode, a maximum set value of the toner amount per unit area of one color toner image formed in the first image forming mode is taken as a reference amount (100%).

In this case, depending on a basis weight of the recording material P, the toner amount was made variable in a range from 60% to 100%. This will be described in more detail.

A phenomenon that the wax-free pre-print paper is wound about the fixing roller occurs based on a relationship between a depositing force of the method toner on the fixing roller surface and rigidity (stiffness). That is, in the case where the stiffness of the recording material P is small, the recording material P is liable to be wound about the fixing roller. For that reason, there is a need to increase the amount of the wax-containing toner of the image to be formed. In the case where the stiffness of the recording material P is large, the recording material P is not readily wound about the fixing roller due to the rigidity of the recording material P, so that the toner image containing the wax in an amount for obtaining necessary glossiness is only required to be formed. This will be described below by using experimental data.

The experiment was conducted by using sheets having the basis weights from 104.7 g/m$^2$ to 209.3 g/m$^2$ ("Golden Cask Satin", mfd. by Oji Paper Co., Ltd.). The basis weight and Gurley stiffness of each of the sheets are shown in Table 1.

TABLE 1

| Paper | Basis weight (g/m$^2$) | Stiffness (mN) |
|---|---|---|
| Golden | 104.7 | 1.31 |
| Cask | 127.9 | 3.62 |
| Satin | 157.0 | 8.77 |
| | 186.0 | 13.78 |
| | 209.3 | 23.32 |

The measurement of the Gurley stiffness was performed by using a Gurley stiffness tester (mfd. by Kumagai Riki Kogyo Co., Ltd.) in accordance with "Testing Methods for Woven Fabrics", bending repulsion (JIS L-1096). On each of the sheets in which the wax-free toner image was fixed, the wax-containing toner image was formed with the toner changed in amount. As a result, with respect to the sheets having the basis weights of 104.7 g/m$^2$ and 127.9 g/m$^2$, the winding jam did not occur with the wax-containing toner in the amount which was 100% of the reference amount. With respect to the basis weight of 157.0 g/m$^2$, the winding jam did not occur in the toner amount which was 70% of the reference amount. Similarly, with respect to the basis weights of 186.0 g/m$^2$ and 209.3 g/m$^2$, the winding jam did not occur in the toner amounts which were 40% and 30% of the reference amount, respectively. From this result, the amount of the wax-containing toner is smaller with an increasing basis weight of the sheets. However, as described above, the constant glossiness was obtained in the toner amount which was 60% or more of the reference amount, so that the toner amount was set at a value which was less than 60% of the reference amount. The toner amounts necessary for the respective basis weights was accumulated as data base in advance, and the toner amount was set so as to be optimum for the basis weight designated by the user.

As a result, in the case where the recording material having been subjected to recording (pre-print paper) is subjected to the multiple fixing, a condition under which improper separation jam on the fixing member can be obviated. As a result, it is possible to reduce a degree of wearing of members relating to the image formation, such as damage on the members due to the jam. Further, it is possible to reduce a down time of the image forming apparatus.

[Embodiment 2]

Figure 6:
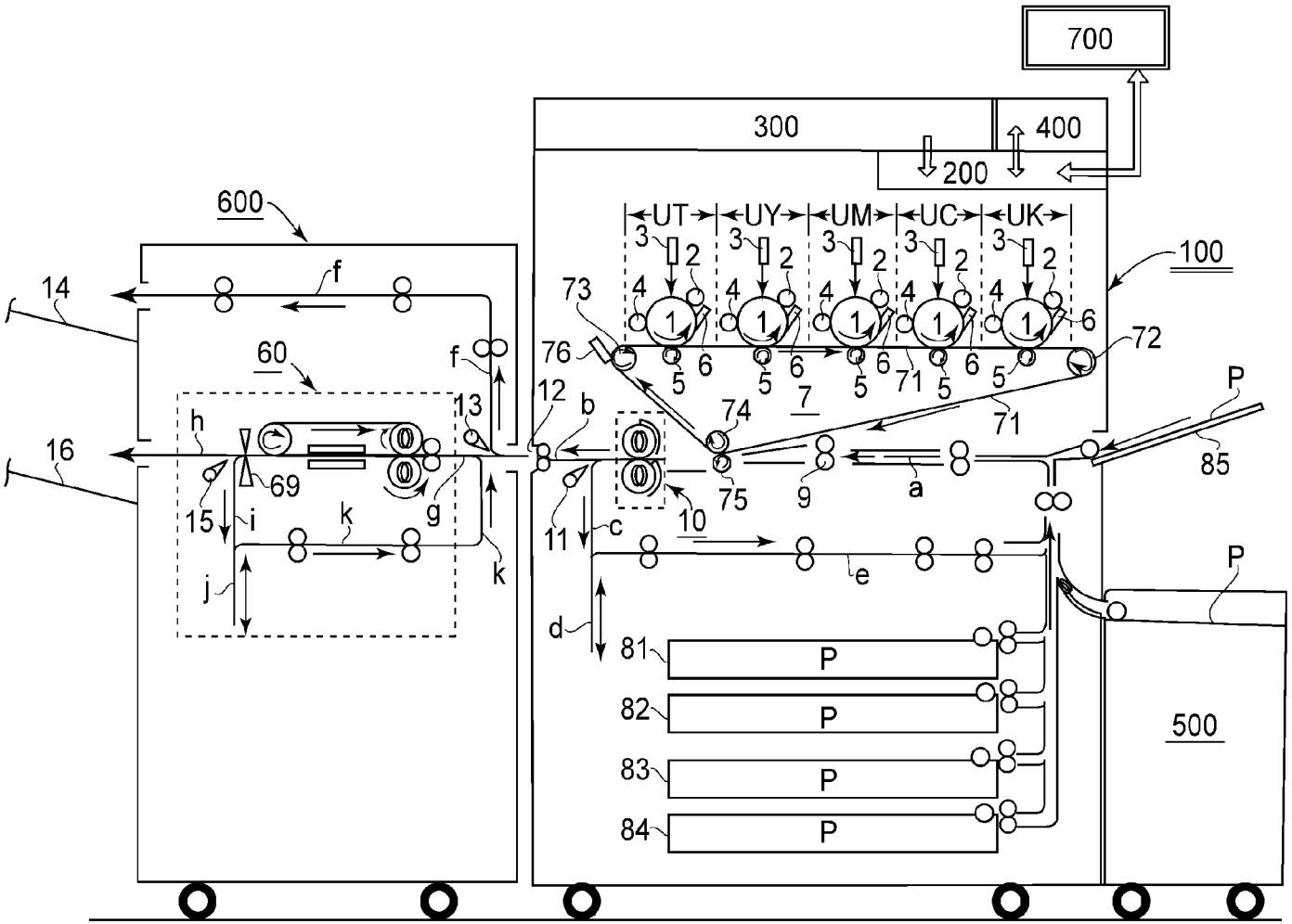
FIG. 6 is a schematic view of an image forming apparatus in Embodiment 2.

FIG. 6 is a schematic structural view of an image forming apparatus 100 in this embodiment. This apparatus 100 includes a glossing unit 600 as a retrofitted optional device disposed on an image formed product discharge opening 12 side in combination with the main assembly thereof. Thus, the image forming apparatus 100 is configured to further process of the image formed product in the "whole coating" mode so as to become the image formed product having photograph-like gloss. The constitution and operation of the apparatus 100 except the glossing unit 600 are similar to those in Embodiment 1, thus being omitted from redundant description.

The recording material P which has been subjected to the image formation in the apparatus 100 is introduced from the discharge opening 12 into the unit 600. In the case where the photograph-like gloss mode is not selected, the recording material P is changed in path toward a conveying path f by a first turning attitude of a second flapper 13. Then, the recording material P passes through the conveying path f without stopping and is discharged onto a first discharging tray 14. Further, in the case where the photograph-like gloss mode is selected, the recording material P is changed in path toward a conveying path g by a second turning attitude of the second flapper 13 and is then introduced into a glossing portion (image glossing means or glossing drum) 60, thus being subjected to the glossing (multiple fixing).

Then, in the case where the recording material P which comes out of the glossing portion 60 is the recording material P which has been subjected to the one-side image forming modem, the recording material P is changed in path toward a conveying path h by a first turning attitude of a third flapper 15 and then is discharged onto a second discharging tray 16. Further, in the case where the recording material P which comes out of the glossing portion 60 is the recording material P which has been subjected to the both-side image forming mode, the recording material P which has been subjected to first-side glossing and has come out of the glossing portion 60 is changed in path toward a conveying path i by a second turning attitude of the third flapper 15. Then, the recording material P is introduced into a switch-back conveying path j. Then, the recording material P is reverse-conveyed through the conveying path j and then is passed through a re-conveying path k, thus being introduced into the conveying path g again. As a result, the recording material P which has been subjected to the first-side glossing is re-introduced into the glossing portion 60 in an upside-down state, and then is subjected to a second surface (side) glossing. Then, the recording material P which has been subjected to the both-side glossing and has come out of the glossing portion 60 is changed in path toward the conveying path h by the first turning attitude of the third flapper 15 and is then discharged onto the second discharging tray 16.

(1) Glossing Portion 60

Figure 7:
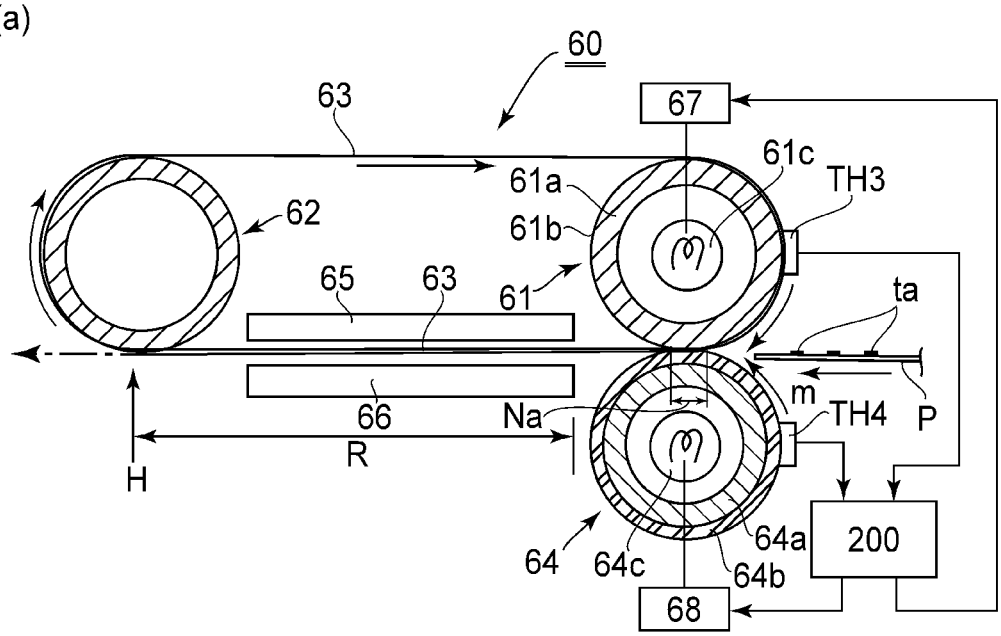
FIG. 7(*a*) is a schematic cross-sectional view of a principal part of a glossing portion, and FIG. 7(*b*) is a schematic view of an image forming mode selection operation screen.
Figure 7:
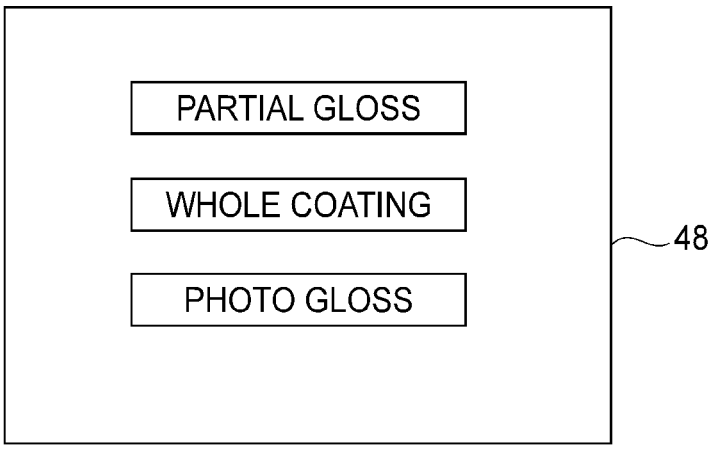

FIG. 7(*a*) is a schematic view of a principal part of the glossing portion (constant gloss processing portion) 60 in the glossing unit 600. The glossing portion 60 brings the recording material P, which has been passed and conveyed through the fixing device 10 of the apparatus 100 and which carries thereon unfixed toner images ta, into intimate contact with a glossing belt surface and heats (multiple-fixes) the recording material P, and then cools the recording material P. Thus, the glossing portion 60 is configured to be of a cooling separation type in which the image surface of the recording material P is smoothed to realize high gloss of the image, and performs a glossing step.

The glossing portion 60 includes heating roller 61 in parallel with tension roller 62 and an endless belt (glossing belt) 63, having a high gloss surface, which is extended around the rollers 61 and 62. The tension roller 62 is located downstream of the heating roller 61 with respect to the recording material conveyance direction m. Below the heating roller 61, a pressing roller 64 disposed in parallel to the heating roller 61 and in contact with the belt 63 contacted to the heating roller 61 is provided. Further, the glossing portion 60 includes first and second cooling means 65 and 66 as belt cooling means disposed inside and outside a lower-side belt portion of the belt 63.

The heat roller 61 is formed as a hollow roller by providing a rubber layer as an elastic layer 61*b* on a core metal 61*a* having good thermal conductivity. The core metal 61*a* is, e.g., a hollow pipe of aluminum. The rubber 61*b* is formed of, e.g., silicone rubber. Inside the heating roller 61, a halogen heater as a heating source 61*c* is disposed. As the heating source, it is also possible to use the IH type heating source utilizing the electromagnetic induction heating.

The tension roller 62 is disposed at a separation portion where the recording material P is to be separated from the belt 63 by its outer diameter curvature. That is, the size of the tension roller 62 is set based on proper diameter and curvature capable of separating the recording material P from the belt 63 "rigidity (stiffness" of the recording material itself.

The belt 63 having the high gloss surface has a function of transferring the high gloss surface so as to follow the toner image surface by being heated in intimate contact with the image surface of the recording material P which passed through the fixing device 10 and has been introduced into the glossing portion 60. The belt 63 having the surface glossiness (60 degree) in the range of 60-100 is used. However, the surface glossiness of the belt 63 can be arbitrarily selected correspondingly to the image glossiness required for the multi-function machine in this embodiment. Further, as a base material for forming a main body of the belt 63, it is possible to use thermosetting resin or heat-resistant resin such as polyimide or use metal or the like. On the base material, a heat-resistant silicone rubber layer is formed. Instead of the silicone rubber, it is also possible to utilize fluorine-containing rubber. Further, on the silicone rubber layer, a fluorine-containing resin layer is formed as a toner parting layer. In this embodiment, the belt 63 having the surface glossiness of 90-100 in terms of the 60-degree glossiness was employed. Further, with respect to a thickness dimension of the belt 63, when the thickness dimension is excessively small, there is a possibility that the strength of the belt itself and the pressing for embedding the toner into a toner receiving layer become insufficient, and when the thickness dimension is excessively large, there is a possibility that heat quantity necessary to heat the belt is increased and thus the embedding of the toner becomes insufficient. Therefore, in this embodiment, the belt 63 having the thickness dimension in the range from 100 μm to 300 μm is used.

The pressing roller 64 is formed as a hollow roller by providing a rubber layer as an elastic layer 64*b* on a core metal 64*a*. The core metal 64*a* is, e.g., a hollow pipe of aluminum. The rubber layer 64*b* is formed of, e.g., silicone rubber. Inside the pressing roller 64, a halogen heater as a heating source 64*c* is disposed. As the heating source, it is also possible to use the IH type heating source utilizing the electromagnetic induction heating. A total pressure at which the pressing roller 64 and the heating roller 61 nip the belt 63 in cooperation with each other is set at 50 kg (490 N) in this embodiment. The pressing roller 64 performs a function of forming a heating nip Na between itself and the belt 63, and in this embodiment, a width of the heating nip Na with respect to the recording material conveyance direction is set at 5 mm.

Each of the first and second cooling devices 65 and 66 is, in this embodiment, of a cooling fan type in which it is provided with an inside duct and an outside duct. Cooling air generated by the fan is configured to pass through the inside duct and the outside duct. A cooling capacity of each of the cooling devices 65 and 66 is set so that the toner is cooled to the neighborhood of the glass transition temperature (point) until the recording material P which has passed through the heating nip Na reaches a position H in which the recording material P is to be separated from the belt surface at the lower surface of the roller 62. Incidentally, the cooling devices 65 and 66 are not limited to the above-described structure including the cooling fan and the like but can also be a heat pipe containing a coolant such as water, a heat sink or a constitution in which Peltier element is contacted to the recording material P. It is also possible to employ such a constitution that both of the cooling devices 65 and 66 are disposed so as to cool the recording material P on only one side of the inside and outside of the lower-side belt portion of the belt 63.

The heating roller 61 is connected to a driving motor (not shown) controlled by the control device 200 through a gear train (not shown) and is rotationally driven in the clockwise direction on the drawing at a predetermined speed by rotational power of the motor. As a result, the belt 63 and the tension roller 62 are also rotated. The pressing roller 64 is rotated by the rotation of the belt 63. On the surface of the belt 63 at a portion where the belt 63 is extended around the heating roller 61, a thermistor TH3 as the detecting means for detecting the temperature of the belt 63 is disposed in contact with or in non-contact with the belt 63.

Further, on the surface of the pressing roller 64, as the detecting means for detecting the temperature of the pressing roller 64, a thermistor TH3 is disposed in contact with or in non-contact with the pressing roller 64. The heating roller 61 is rotationally moved and thus in a state in which the belt 63 and the pressing roller 64 are rotated, to the heating sources 61*c* and 64*c*, power is supplied from energization circuit portions 67 and 68, respectively. As a result, the heating roller 61 and the pressing roller 64 are heated by an internal heating method. Then, the surface temperatures of the heating roller 61 and the pressing roller 64 are detected by the thermistors TH3 and TH4, respectively. Electric information (temperature detection signals) on the surface temperatures of the both the belt 63 and the pressing roller 64 detected by the thermistors TH3 and TH4 is inputted into a temperature control function portion of the control device 200. The temperature control function portion effects ON/OFF control of energization from the energization circuit portion 67 to the heating source 61*c* so that the temperature detecting signals inputted from the thermistor TH3 is kept at that corresponding to a belt temperature set for the belt 63. Further, the temperature control function portion effects ON/OFF control of energization from the energization circuit portion 68 to the heating source 64*c* so that the temperature detecting signals inputted from the thermistor TH4 is kept at that corresponding to a pressing roller temperature set for the pressing roller 64. In this embodiment, the belt temperature of the fixing roller 21 is set at 130° C. and the pressing roller temperature is set at 90° C., and the belt 63 and the pressing roller 64 are temperature-controlled by the control by the temperature control function portion of the control device 200 so as to keep the belt temperature and the pressing roller temperature.

In the case where the image forming mode is the photograph-like gloss mode described later, the recording material P sent from the fixing device 10 in a state in which the fixing in the fixing device 10 is completed and then the temperature of the recording material P is kept at a high temperature of e.g., about 80° C. is introduced into the glossing portion 60. The recording material P sent to the glossing portion 60 is heated and pressed in the heating nip Na at its image surface. At this time, the toner images to are heated up to a temperature which is sufficiently higher than the glass transition temperature (Tg), specifically up to about 110° C. Thereafter, the recording material P is conveyed in a cooling area R while being intimately contacted to the outer belt surface which is the high gloss surface of the belt 63, and is cooled until the temperature is decreased down to the set temperature of the cooling devices 65 and 66, e.g., about 50° C. which is lower than the glass transition temperature (Tg) of the toner. By subjecting the recording material P to the cooling, the toner image after the cooling is increased in gloss while following the high gloss surface of the belt 63. Then, the sufficiently cooled recording material P starts to be separated, at the separation portion H located at the lower surface of the tension roller 62, by its own rigidity or stiffness. As a result, the solidified toner is not transferred onto the surface of the belt 63, thus preventing the image surface from causing surface unevenness to be roughened. In the glossing portion (means) 60 in this embodiment, the toner separation temperature at which the recording material P starts the separation from the belt 63 is sufficiently lower that in the fixing device 10. That is, the fixing device 10 is of the "high temperature separation type", whereas the glossing portion 60 is of the "low temperature separation type" in which the recording material P starts the separation from the belt 63 in a state in which the temperature of the toner on the recording material P is low.

The recording material P separated from the belt 63 can be outputted in a margin-less state by cutting away and removing an end margin with a cutter 69 (FIG. 6) as desired. The recording material P after completion of the glossing step by the smoothing described above is discharged onto the second discharging tray 16, so that a series of image formation on the recording material P is ended. The outputted image surface showed the 60-degree glossiness of about 90%.

(2) Image Forming Mode

In the apparatus 100 in this embodiment, the first image forming portion UT forms the transparent toner image. Further, the apparatus 100 in this embodiment is operable in the following three image forming modes (print modes).

First is a first image forming mode in which the toner image depending on the image data is formed on the recording material P. In this mode in this embodiment, by the first image forming portion UT for forming the transparent toner image, an image pattern is partly formed on the recording material P with the transparent toner and is used to represent partial gloss difference.

Second is a second image forming mode in which the toner image is formed so as to uniformly coat the whole surface of the recording material P with the toner. In this mode in this embodiment, by the first image forming portion UT for forming the transparent toner image, the whole surface of the recording material P is coated with the transparent toner and is used to represent uniform gloss.

Third is a third image forming mode in which the recording material P which was coated at its whole surface in the second image forming mode and has been passed through the fixing device 10 is subjected to the high glossing process. In this mode in this embodiment, the recording material P which was coated at its whole surface in the second image forming mode and has been passed through the fixing device 10 is further introduced into the glossing portion 60 to obtain an image formed product with photograph-like gloss.

A shown in FIG. 7(*b*), by an image forming mode selection means 48 (selection screen of touch panel type) at the display portion of the operating portion 400, each of the above-described three image forming modes of "PARTIAL GLOSS", "WHOLE COATING", and "PHOTO GLOSS (PHOTOGRAPH-LIKE GLOSS)" is selectable. Alternatively, on the printer driver screen displayed on a display of the PC which is the external host device 700, each of the three modes can be designated by a mouse pointer.

When the image forming mode is selected by the selection means 48 shown in FIG. 7(*b*), as shown in FIG. 2(*a*), the screen 41 (recording material type designating means) for selecting the type of the recording material used for sheet passing is displayed. In this embodiment, in the first to third sheet feeding cassettes 81, 82, and 83 and the manual feeding tray 85, as unused recording material (white paper) which has not been subjected to the image formation, plain paper, coated paper, coated paper and plain paper are accommodated, respectively. Further, in the fourth sheet feeding cassette 84 and the sheet feeding deck 500, plain paper (]pre-print) which has already been subjected to the image formation (recording) and pre-print of coated paper are accommodated, respectively. The type of the recording material accommodated in the cassette set by the user is detected by the control device 200 as an obtaining means. Specifically, the control device 200 accesses a memory storing the information of the recording material, to be used, registered by the operation of the operating portion by the user, thus obtaining the type of the recording material used for the image formation. Incidentally, a media sensor for discriminating the type of the recording material or an optical sensor or the like for detecting whether or not the image is formed on the recording material may also be used. In the case where the media sensor is provided, when the basis weight of the recording material obtained by the media sensor is large, the jam is not readily caused even when the recording material is the pre-print paper. For that reason, even when the recording material is the pre-print paper, the control may also be effected so as to permit the execution of the partial gloss mode when the recording material has a basis weight which is not less than a predetermined basis weight.

Figure 8A:
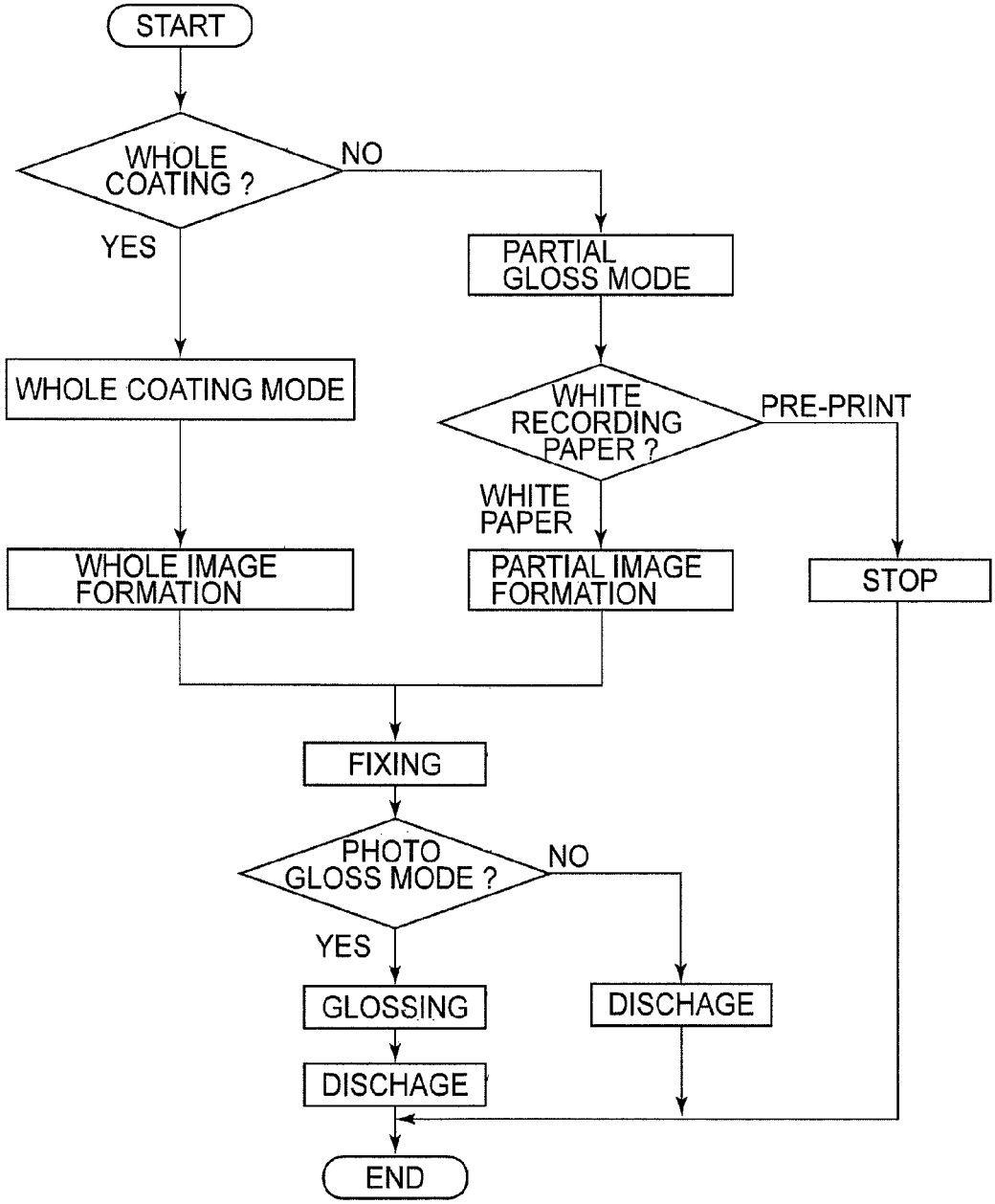
FIG. 8A is a flowchart of an image forming operation.

The control device 200 performs, on the basis of the above-described image forming mode and the selection of the type of the recording material, the image forming operation of the apparatus and the glossing unit 600 in accordance with an operation flow shown in FIG. 8A. That is, in the case where the recording material which has been designated by the recording material type designating means 48 and which is to be used for sheet passing in the apparatus is the unused recording material (white paper), the execution of the image formation in the partial gloss mode (first image forming mode) or the whole (surface) coating mode (second image forming mode) is permitted. In the case where the recording material is the recording material (pre-print paper) which has been subjected to the recording, the execution of the image formation in the whole coating mode is permitted but the execution of the image formation in the partial gloss mode is forbidden.

Incidentally, in the case where the toner image is formed on the pre-print paper, even when either of whether the selection of the partial gloss mode is forbidden or the execution of the partial gloss mode is forbidden is selected, there is no change in that the jam occurrence can be suppressed. Incidentally, the user is permitted to select the mode in which the transparent toner image is partly formed on the pre-print paper and thereafter, a massage to the effect that the execution of the mode is forbidden may also be displayed on the display in order to notify the user of the massage. However, this is complicated and therefore when the user select the pre-print paper, it is preferable that the selection of the partial gloss mode in which the transparent toner image is partly formed is forbidden. Similarly, in the case where the user first selects the partial gloss mode, in view of usability, it is preferable that the selection of the pre-print paper as the sheet to be subjected to the image formation is forbidden.

Incidentally, the image on the pre-print paper is not always formed with the wax-less toner. For that reason, even in the case where the recording material on which the image is to be formed is the pre-print paper, the selection of the partial gloss mode by the user may also be permitted. However, there is a possibility that the image on the pre-print paper is formed with the wax-less toner and therefore warning to the effect that a possibility of the jam (occurrence) is high is always displayed when the user selects the partial gloss mode.

Figure 8B:
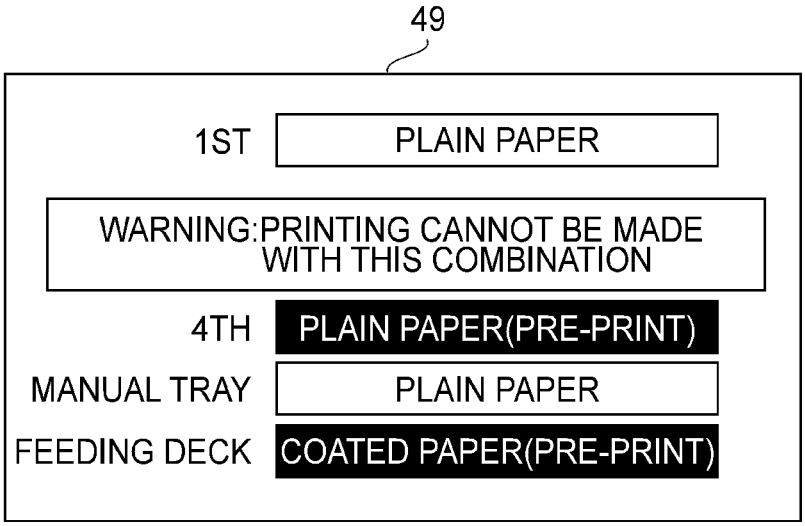
FIGS. 8B and 8C are schematic views each showing a warning display screen.
Figure 8C:
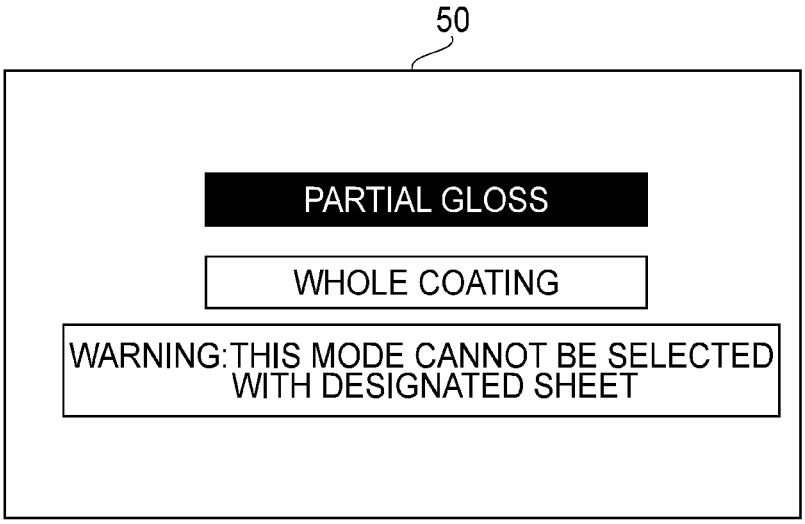

In this embodiment, in the case where the selected image forming mode and the selected type of the recording material P are designated as a combination of the "partial gloss" mode and the "pre-print paper", the image forming operation is not performed. That is, as shown in FIGS. 8B and 8C, warning such that "PRINTING CANNOT BE MADE" or the like is displayed on a screen 49 or 50 at the display portion of the operating portion 400, so that the image forming operation is not performed. Thus output of the pre-print paper in combination with the "partial gloss" mode is forbidden. As a result, even if the pre-printed recording material (pre-print paper) which has been outputted with the toner containing no parting agent is subjected to the multiple fixing, it become possible to obviate the occurrence of the fixing winding jam in the fixing device 10.

[Embodiment 3]

Figure 9A:
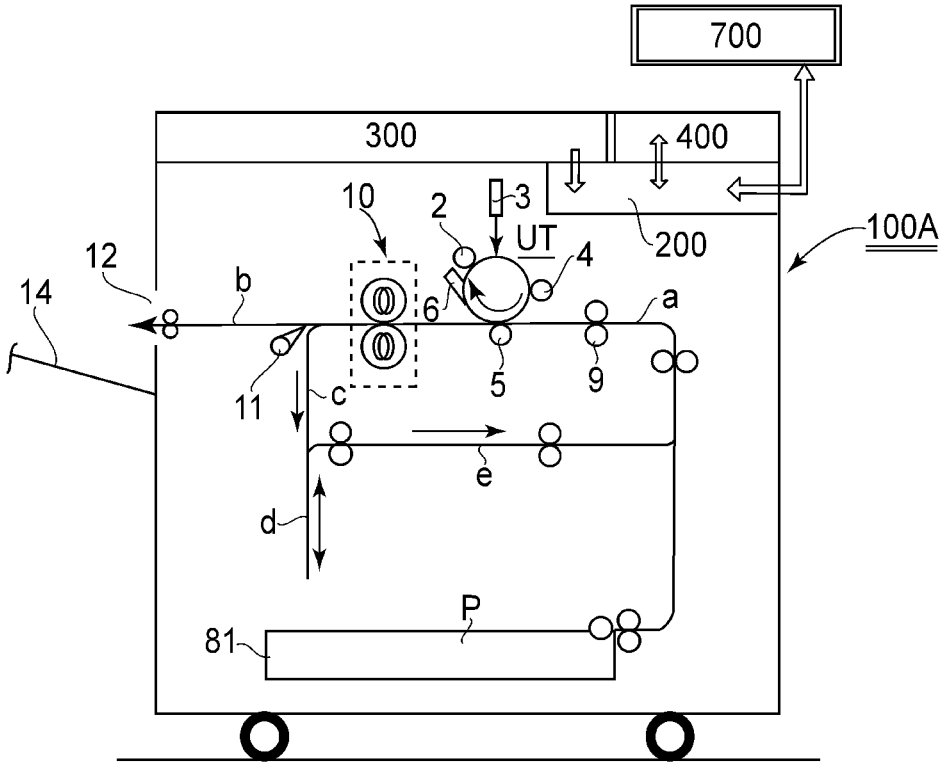
FIG. 9A is a schematic view of an image forming apparatus in Embodiment 3.
Figure 9B:
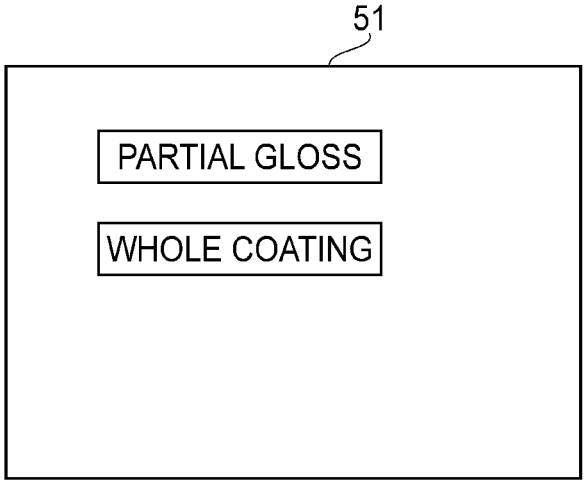
FIG. 9B is a schematic view of a mode selection screen at the display portion of the operating portion.
Figure 9C:
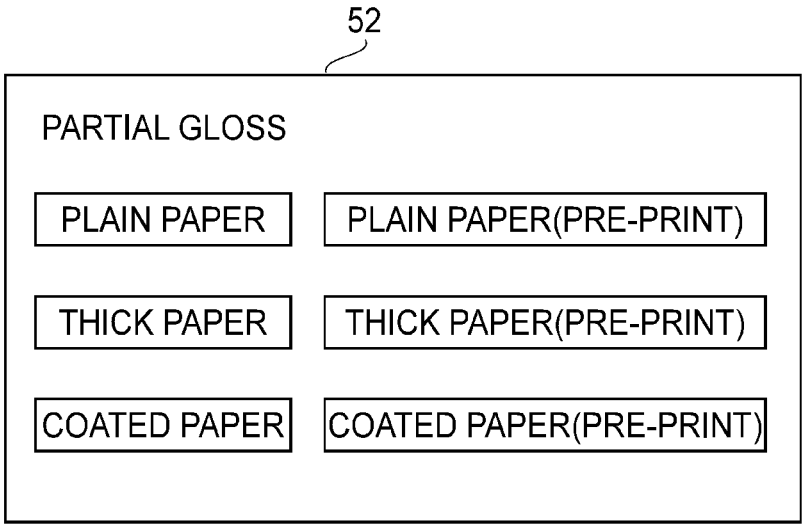
FIG. 9C is a schematic view of an operation screen on which the type of a recording material is designated in the case where a partial gloss mode is selected.
Figure 9D:
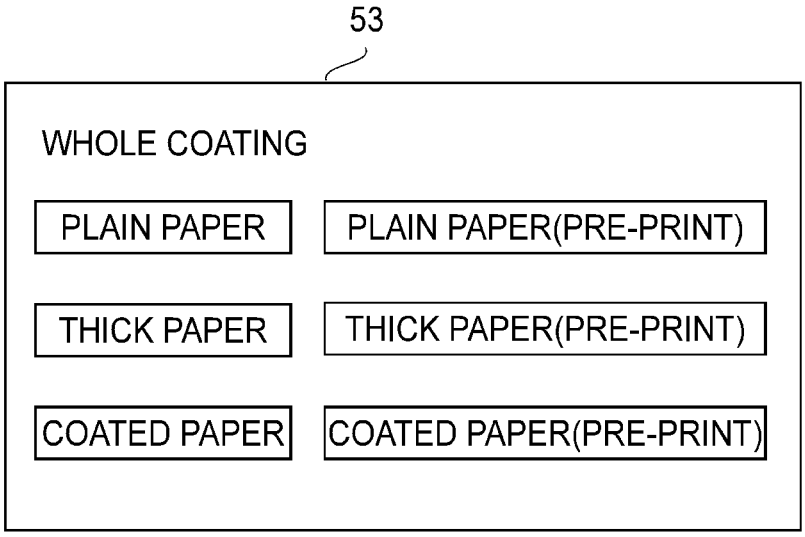
FIG. 9D is a schematic view of the operation screen on which the type of the recording material is designated in the case where a whole area coating mode is selected.
Figure 10:
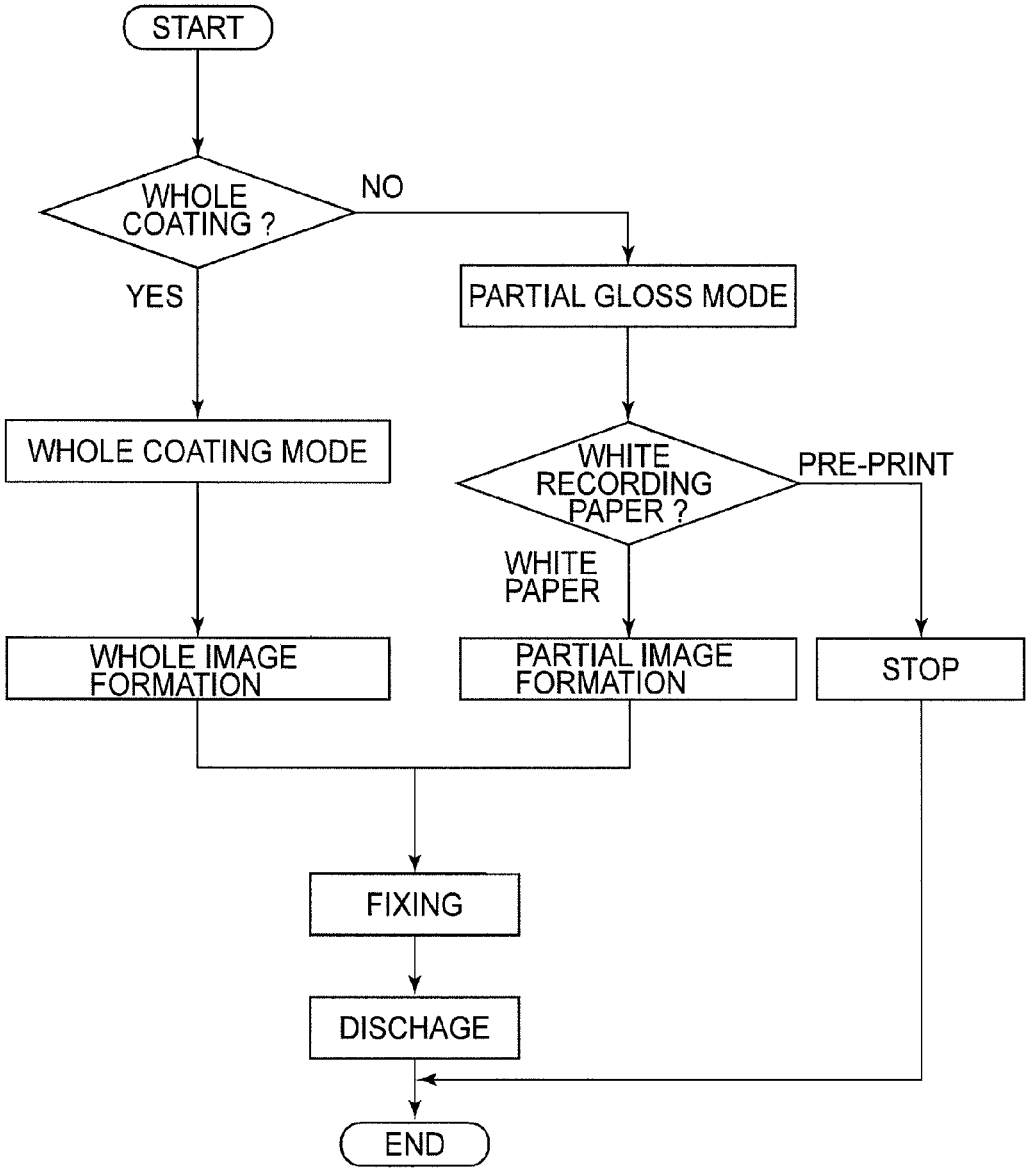
FIG. 10 is a flowchart of an image forming operation.

FIG. 9A is a schematic view of an image forming apparatus 100A in this embodiment. This apparatus 100A is an apparatus (machine for clear (transparent)) for dedicatedly forming the transparent toner image on the recording material P. The constitution of the first image forming portion UT is the same electrophotographic process mechanism as that of the first image forming portion UT for forming the transparent toner image in the apparatus 100 (FIG. 1) in Embodiment 1. Also the fixing device 10 is the heating roller fixing device of the oil-less fixing type similar to that in the apparatus 100 in Embodiment 1. In addition, other constituent members or portions common to the image forming apparatus 100 in Embodiment 1 are represented by the same reference numerals or symbols and will be omitted from redundant description. FIGS. 9B, 9C and 9D are schematic views of display screens of the operating portion 400, and FIG. 10 is a flowchart of the image forming operation.

The image forming apparatus 100A in this embodiment is operable in two image forming modes. One is a mode (first image forming mode) in which an image pattern with the transparent toner is partly formed on the recording material P to be subjected to the sheet passing and is used to represent partial gloss difference. The other is a mode (second image forming mode) in which the transparent toner is coated on the whole surface of the recording material P to be subjected to the sheet passing and is used to represent uniform gloss. As shown in FIG. 9B, as the operating screen, a screen 51 for selecting the "partial gloss" mode or the "whole coating" mode was displayed. When the mode selection is made on the screen 51, the control device 200 as the control means causes the display portion of the operating portion 400 to display the screen for selecting the type of the recording material to be used for the sheet passing in the apparatus, as shown in FIG. 9C or 9D. In this case, when the "partial gloss" mode is selected, as shown in FIG. 9C, a massage that the pre-print paper cannot be designated as the recording material was displayed. When the "whole coating" mode is selected, as shown in FIG. 9D, a massage that the pre-print paper can be selected was displayed. As a result, it was possible to prevent the user from erroneously using the pre-print paper in the partial gloss mode to cause the fixing winding jam.

[Embodiment 4]

Figure 11:
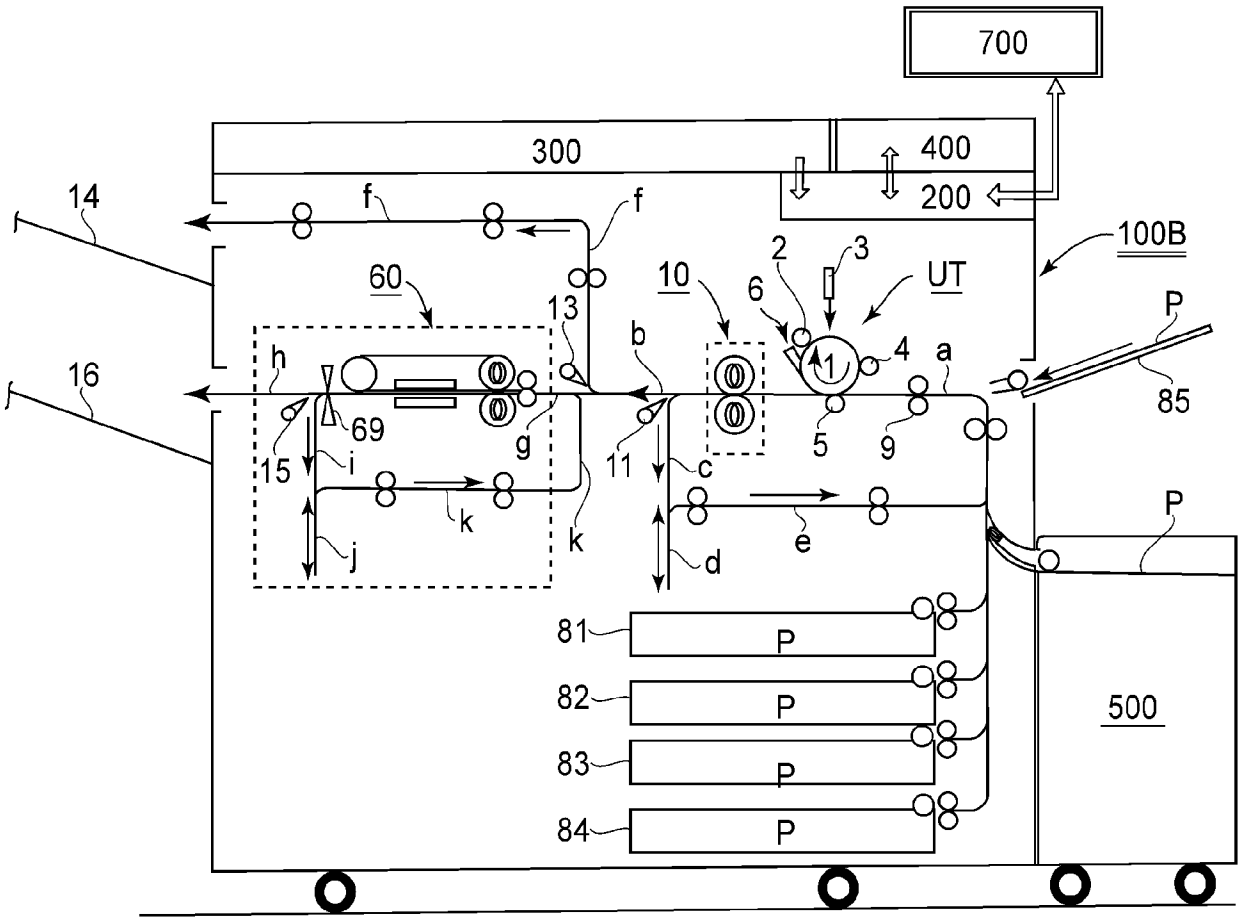
FIG. 11 is a schematic view of an image forming apparatus in Embodiment 4.

FIG. 11 is a schematic view of an image forming apparatus 100B in this embodiment. This apparatus 100A is also an apparatus (machine for clear (transparent)) for dedicatedly forming the transparent toner image on the recording material P similarly as in the image forming apparatus 100A in gloss 3. The constitution of the first image forming portion UT is the same electrophotographic process mechanism as that of the first image forming portion UT for forming the transparent toner image in the image forming apparatus 100 in Embodiment 1. Also the fixing device 10 is the heating roller fixing device of the oil-less fixing type similar to that in the apparatus 100 in Embodiment 1. In the apparatus 100B in this embodiment, the glossing portion 60 similar to that in the glossing unit 600 in the apparatus 100 (FIG. 6) in Embodiment 2 is incorporated. Therefore, in the apparatus 100B in this embodiment, the photograph-like mode can be selected. In addition, other constituent members or portions common to the image forming apparatuses 100 and 100A in Embodiments 1 to 3 are represented by the same reference numerals or symbols and will be omitted from redundant description.

The apparatus 100B in this embodiment is operable in the following three image forming modes (print modes) similarly as in the image forming apparatus 100 in Embodiment 1.

First is the mode (first image forming mode) in which an image pattern is partly formed on the recording material P with the transparent toner and is used to represent partial gloss difference. Second is the mode (second image forming mode) in which the whole surface of the recording material P is coated with the transparent toner and is used to represent uniform gloss. Third is the photograph-like mode (third image forming mode) in which the whole surface of the recording material P is coated and thereafter the recording material P is subjected to the high glossing process.

A shown in FIG. 7(*b*), by the image forming mode selection means 48 on the operating portion 400, each of the above-described three image forming modes of "PARTIAL GLOSS", "WHOLE COATING", and "PHOTO GLOSS (PHOTOGRAPH-LIKE GLOSS)" is selectable. Alternatively, on the printer driver screen displayed on a display of the PC which is the external host device 700, each of the three modes can be designated by a mouse pointer.

That is, the image forming apparatus 100B includes a notifying means (e.g., an ethernet controller) for notifying an information terminal (PC or the like), connected to thereto, of information. Then, in the case where the toner image has already been formed on the recording material used for the image formation, the control device 200 provided in the image forming apparatus 100B notifies the PC, through the notifying means, that the execution of the mode in which the image is formed with the transparent toner on a part of the recording material on which the image has already been formed is forbidden. As a result, the selection, by the information terminal, of the mode in which the transparent toner image is formed on the part of the recording material is forbidden.

When the image forming mode is selected on the mode selection screen 48, as shown in FIG. 2(*a*), the screen 41 (recording material type designating means) for selecting the type of the recording material used for sheet passing is displayed.

The control device 200 performs, on the basis of the above-described image forming mode and the selection of the type of the recording material, the image forming operation of the image forming apparatus 100B in accordance with an operation flow shown in FIG. 8A.

Further, in this embodiment, in the case where the selected image forming mode and the selected type of the recording material P are designated as a combination of the "partial gloss"mode and the "pre-print paper", the image forming operation is not performed. That is, as shown in FIGS. 8B and 8C, warning such that "PRINTING CANNOT BE MADE" or the like is displayed on a screen 49 or 50 at the display portion of the operating portion 400, so that the image forming operation is not performed. Thus output of the pre-print paper in combination with the "partial gloss" mode is forbidden, so that even if the pre-print paper which has been outputted with the toner containing no parting agent is subjected to the multiple fixing, it become possible to obviate the occurrence of the fixing winding jam in the fixing device 10.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 273258/2009 filed Dec. 1, 2009, which is hereby incorporated by reference.

What is claimed is:

1. An image forming apparatus comprising:

a placing portion where a recording material is placed;

obtaining means for obtaining information as to whether or not the recording material has already been subjected to image formation before the recording material is placed to said placing portion;

image forming means for forming a transparent toner image on a recording material with transparent toner containing a parting agent;

fixing means for fixing on the recording material the transparent toner image formed by said image forming means;

selecting means for selecting a mode to be executed from a first image forming mode in which the transparent toner image is partly formed in an image formable area on a surface of the recording material by said image forming means and a second image forming mode in which the transparent toner image is formed so that a whole surface of the recording material is coated in the image formable area with the transparent toner by said image forming means; and control means for controlling execution of a mode so that execution of the first image forming mode and execution of the second image forming mode are permitted when the information indicates that the recording material has not been subjected to image formation before the recording material is placed to said placing portion and so that execution of the second image forming mode is permitted but execution of the first image forming mode is forbidden when the information indicates that the recording material has already been subjected to image formation before the recording material is placed to said placing portion.

2. An image forming apparatus according to claim 1, further comprising another obtaining means for obtaining information as to a basis weight of the recording material, wherein said control means changes a toner amount per unit area of the toner image to be formed on the recording material in the second image forming mode.

3. An image forming apparatus according to claim 1, further comprising color image forming means for forming on the recording material a toner image with color toner containing the parting agent.

4. An image forming apparatus according to claim 1, further comprising notifying means for notifying an information terminal, connected to said image forming apparatus through a network, of information, wherein said control means notifies the information terminal through said notifying means that execution of a mode in which a toner image is formed with the transparent toner on a part of the recording material on which a toner image has already been formed is forbidden.

* * * * *